United States Patent [19]

Kraus et al.

[11] B 3,992,605

[45] Nov. 16, 1976

[54] ELECTRICALLY HEATED PARTING TOOL FOR REMOVING WINDSHIELDS

[76] Inventors: Hans Kraus, 5156 Banna Ave., Covina, Calif. 91724; Wesley R. Willhite, Jr., 1345 N. Birchnall Ave., San Dimas, Calif. 91773

[22] Filed: Apr. 23, 1974

[21] Appl. No.: 463,388

[44] Published under the second Trial Voluntary Protest Program on February 10, 1976 as document No. B 463,388.

[52] U.S. Cl. ..... 219/233; 30/140; 83/171; 128/303.14; 219/235; 219/240; 219/533

[51] Int. Cl.[2] ..... H05B 1/00; B26B 3/08

[58] Field of Search ..... 219/221, 227, 230, 233, 219/235, 533, 240; 30/140; 128/303.1, 303.14; 83/170, 171

[56] References Cited

UNITED STATES PATENTS

| | | | |
|---|---|---|---|
| 1,834,555 | 12/1931 | Tittle | 219/233 UX |
| 2,012,938 | 9/1935 | Beuoy | 219/233 |
| 2,200,322 | 5/1940 | Arnesen | 219/233 UX |
| 2,421,125 | 5/1947 | Krebs | 30/140 |
| 2,501,192 | 3/1950 | Scholler | 219/233 |
| 2,701,835 | 2/1955 | Anton | 30/140 |
| 2,709,743 | 5/1955 | Mitchell | 219/235 X |
| 2,978,565 | 4/1961 | Sullivan et al. | 219/221 X |
| 3,263,540 | 8/1966 | Lefevre et al. | 83/171 |
| 3,448,517 | 6/1969 | Cothery | 30/140 |
| 3,558,854 | 1/1971 | Siegel et al. | 219/233 |

FOREIGN PATENTS OR APPLICATIONS

| | | | |
|---|---|---|---|
| 832,358 | 6/1938 | France | 128/303.14 |
| 1,315,489 | 12/1962 | France | 219/233 |

*Primary Examiner*—A. Bartis
*Attorney, Agent, or Firm*—Boniard I. Brown

[57] ABSTRACT

An electrically heated parting tool for removing windshields and other uses has a holder in the form of a long slender housing mounting a blade-like parting element at one end. The parting element is constructed of thin flat sheet metal and has a generally U-shape including a pair of thin flat leg portions disposed in coplanar relation and joined by a thin flat connecting portion defining a tip end. The free ends of the element leg portions are secured to a high temperature resistant ceramic-like support member recessed into one side of the holder. The parting element extends longitudinally from the holder and has a right angle bend between the holder and tip end whereby the tip end extends laterally of and toward the opposite side of the holder in spaced relation to the holder end. The holder includes a housing at the opposite end in which is located a step-down transformer connected to the leg portions of the parting element by leads extending through the holder.

3 Claims, 5 Drawing Figures

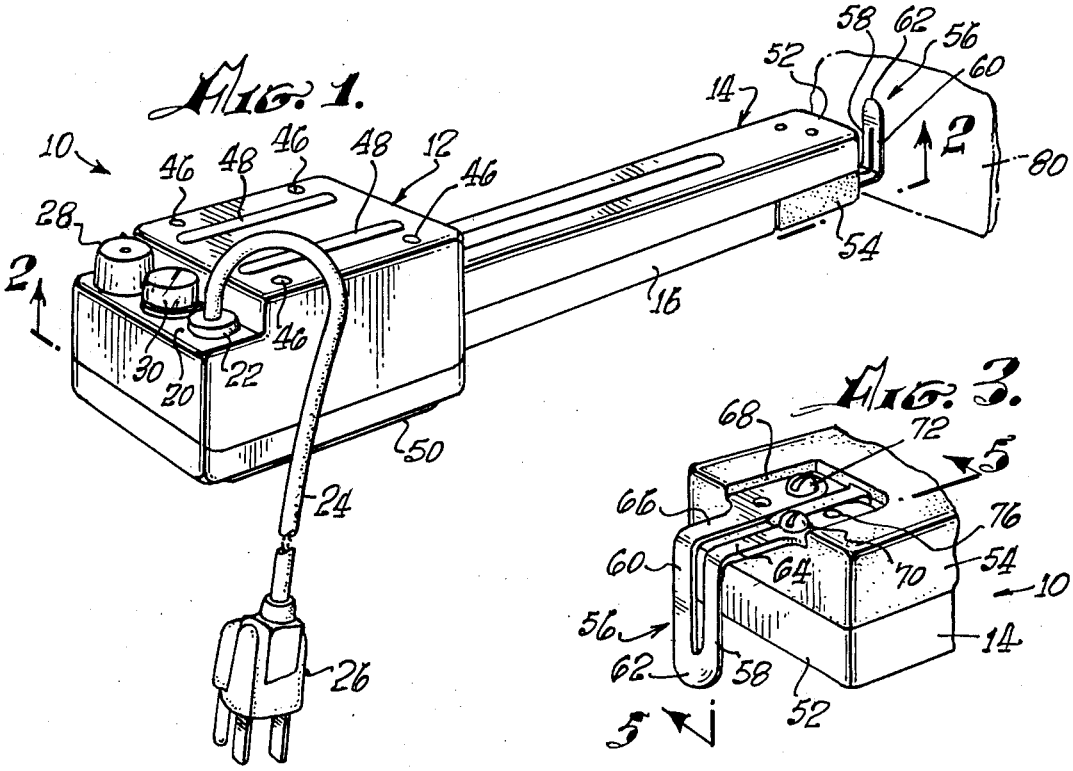
FIG. 1.
10
12
14
16
20
22
24
26
28
30
46
48
50
52
54
56
58
60
62
80
2
FIG. 3.
5
10
14
52
54
56
58
60
62
64
66
68
70
72
76
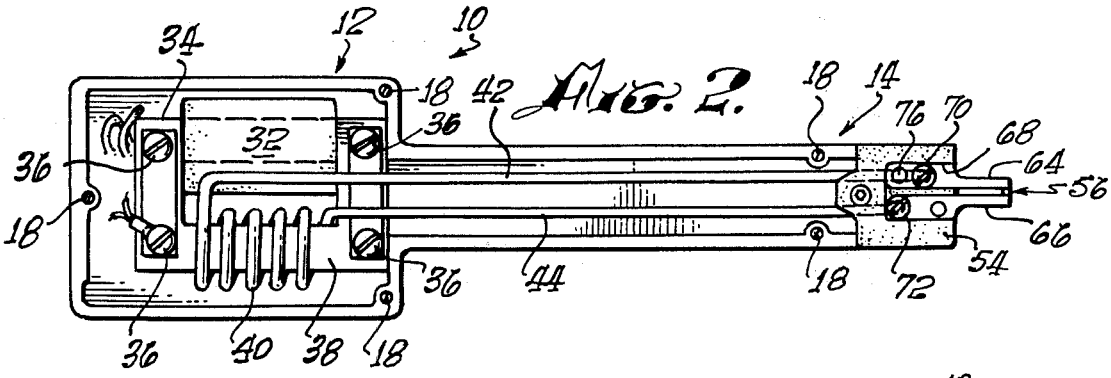
FIG. 2.
10
12
14
18
32
34
36
38
40
42
44
54
56
66
68
70
72
76
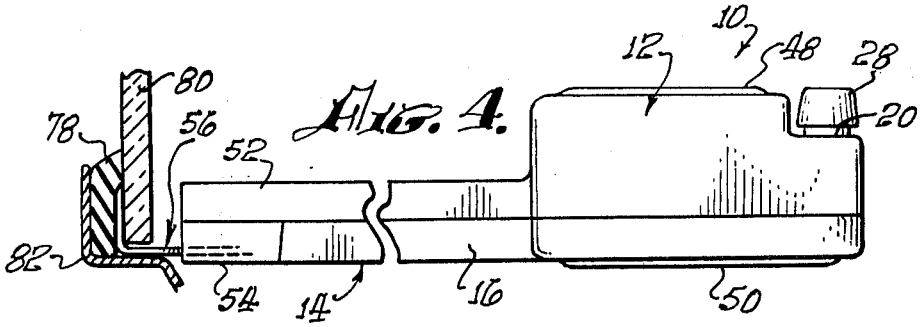
FIG. 4.
10
12
14
16
20
28
48
50
52
54
56
78
80
82
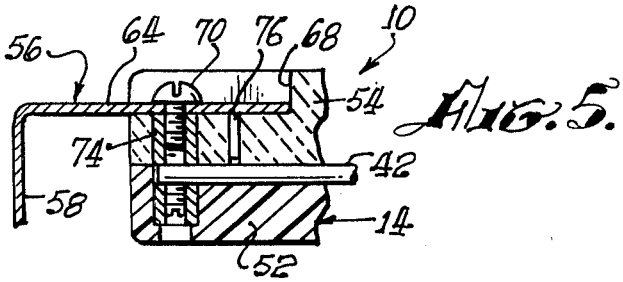
FIG. 5.
10
14
42
52
54
56
58
64
68
70
74
76

ELECTRICALLY HEATED PARTING TOOL FOR REMOVING WINDSHIELDS

BACKGROUND OF THE INVENTION

1. Field of the Invention

This invention is concerned generally with parting tools having a heating element for heating the workpiece to be parted, and is more particularly concerned with parting tools of the type required for heating and melting the mastic or mastic-like material utilized around the edges of automotive vehicular windshields, and wherein the mastic effects a waterproofing seal between the windshield and the body of the vehicle.

2. Description of the Prior Art

Parting tools for assisting in the removal of automobile windshields are known in which a shaped knife is utilized to break the seal of the rubber or other mastic, exterior means being employed to heat the knife for the purpose of softening and melting the sealant. To this end it has been common in the prior art to employ a knife having a portion in heat transfer contact with a heater assembly.

In one such embodiment the tool is provided with a handle and end members separated by a tubular member, the end member being partially hollow with a recess which receives an electrical heating element coupled by conductors which extend back through the tubular member and hanlde to an electrical cord. The knife is secured to the exterior of the end member so as to be heated by the heating element therewithin.

There is a serious and hazardous disadvantage to such a structural arrangement since the entire end member is heated by its enclosed heating element. On the other hand this type of arrangement has been practically dictated (up to the time of the present invention) by the necessity of maintaining a relatively small knife with a thin profile configuration with precludes the possibility of forming the knife over any sort of heating element — hence the prior art requirement for heat transfer arrangements of one sort or another.

SUMMARY OF THE INVENTION

It is a general object of the invention to provide a parting tool of the type used for breaking the waterproofing seal between an automotive windshield and the vehicular frame. It is a further general object to provide such a tool with self heating means for heating only the knife portion of the tool which enters into the sealed material when a parting operation is being accomplished.

It is a further object to provide a tool as aforesaid in which the knife portion is secured mechanically to insulating means for preventing to the degree possible the transfer of heat from the knife portion to that portion of the tool to which the insulating means is secure. It is a particular object to provide electrical means for effecting self-heating of the knife portion.

It is yet another object to provide a parting tool having a housing enclosing a step down transformer with a primary winding having a cord adapted for plugging into a convenience outlet, and having a secondary winding with a pair of power outlet conductors extending through an elongate handle-like extension of the housing to an end thereof, whereat is disposed a ceramic like block arranged to provide insulation against heat transfer to the housing from a self heating knife means secured on the block and coupled electrically to the aforesaid secondary conductors. It is a particular object to provide a tool as aforesaid in which the self heating knife means is formed of substantially low electrical metal material adapted to withstand temperatures up to about 1,100°F for effecting softening and at least partial melting of urethane materials used in bonding and sealing windshields in later model vehicles.

It is a further particular object to provide a parting tool with a generally planar blade-like element having substantially flat faced leg portions of thin configuration coupled at one end of each of the leg portions by a substantially flat faced joinder integral portion of thin configuration, the element being formed by a substantially low electrical resistance metal material adapted to self-heating upon the flow of electrical current therethrough, and means for applying electrical current to said element.

Other and further object of the invention will be apparent upon consideration of the drawing when considered in connection with the description thereof hereinbelow.

BRIEF DESCRIPTION OF THE DRAWINGS

FIG. 1 is a perspective view of the preferred embodiment of the invention;

FIG. 2 is a view taken on the line 2—2 of FIG. 1, showing the housing interior with the bottom cover removed;

FIG. 3 is an enlarged fragmentary view in perspective showing the self-heating blade element;

FIG. 4 is a side elevation view of the device of the invention showing it in use; and FIG. 5 is an enlarged fragmentary view in cross-section, taken on the line 5—5 of FIG. 3.

DESCRIPTION OF THE PREFERRED EMBODIMENT

Referring to the drawing there is shown on FIGS. 1, 2 and 4 a parting tool assembly 10 adapted to assist in removing an automotive windshield from a vehicle. It will be understood, of course, that the tool has more extensive use possibilities, hence the specific tool configuration and use as described is only exemplary and not to be construed in a limiting sense. The assembly 10 comprises an enlarged housing portion 12 and an elongate housing portion 14 having one end integral with the enlarged portion 12. Both housing portions are substantially hollow, being of somewhat thin walled construction formed of any preferred material such as dye cast metal, for example. If preferred, the housing may be formed of high impact plastic material of a type adapted to the use. A bottom cover 16 is provided to cover the opening on the bottom side of the portions 12 and 14, screws 18 (FIG. 2) being provided to secure the cover to the housing portions.

Referring to FIG. 1, the enlarged housing portion 12 has a lowered step wall 20 provided to receive a grommet 22 therewithin to permit a line cord 24 to be received therethrough. A plug 26 on one end of the cord 24 is provided for plugging into a source of electrical power, with the other end of the cord 24 within the housing arranged for coupling to a switch 28 adapted to control the power to a pilot light 30 and the primary winding 32 of a transformer 34 disposed within the housing portion 12. The simple electrical circuit to accomplish this on-off control is well known and need not be described in detail. Suffice it to say that when the switch 28 is turned on the pilot light 30 lights up to indicate that electrical power is being applied to the primary winding 32. The transformer 34 is secured to the housing portion 12 by screws 36 which pass through the transformer laminations 38 to be received in bosses (not shown) formed on the interior side of the enlarged housing portion 12, as will be easily understood by those skilled in the art.

The transformer 34 is provided with a step down secondary winding 40 having elongate leads 42 and 44 traversing the elongate housing portion 14 to be coupled to a self heating element as will be described further below. In operation the transformer will be heated somewhat and it is preferred to provide ventilating holes 46 in the housing portion 12 in order to provide a convection cooling air flow around the transformer. To assist in the removal of heat which may be conducted to the housing portion 12, there are provided ribs 48 thereon and ribs 50 on the bottom cover 16 so that when the tool assembly 10 is rested on a surface the housing and cover will not restrict the flow of convection cooling air around the enlarged housing, and also to raise the housing off any surface upon which it is rested, to assure that the ventilating holes are not blocked.

The end 52 of the elongate housing portion 14 which is distal of the enlarged housing portion 12 is provided with a heat resistive and insualting block 54 which may be cemented into the end 52 or secured thereon in any other preferred fashion. The block 54 is of ceramic-like material formed of mica and glass and available commercially under the trade designation of SUPREMICA No. 620 BB. It will be appreciated, of course, that the block may be formed of any other material suitable for the purpose. The particular material set forth here is preferred since it is easily formed and resists temperatures upwardly of 1100°F which is the general neighborhood of the temperature reached by the heating element secured on the block 54 as will now be described.

An electrically heated blade-like element, shown here generally at 56, is coupled to the distal ends of the conductors 42 and 44. The element 56 is slotted to provide the element with spaced leg portions 58 and 60 joined at their tip ends by a connecting portion 62. Projection portions 64, 66 extend at right angles from the respective leg portions 58, 60 toward the insulating block 54 into a well 68 which is recessed from the face on the opposite side of the block 54 from the face which fays the housing end 52. The element 56 is secured to the block 54 by screws 70 and 72 which are threadedly received in bushings (not shown on FIGS. 1 to 4) secured in the block 54. One such bushing is shown at 74 on FIG. 5, preferably cemented in a bore in the block 54. The bushing 74 has a bore to receive the end of the conductor 42 which extends through a contiguous bore in the block 54. The screw 70 secures the projection leg 64 firmly to the block 54, and a dowel 76 staked to the leg portion 64 projects into a small bore in the block 54 to provide added mechanical strength. The end of a set screw bears against the end of the conductor 42, as shown, to provide a good electrical connection therebetween so that current may flow from the conductor 42 through set screw 70, bushing 74, element portions 64, 58, 62, 60 and 66, and through the screw 72 to the conductor 44.

As noted hereinabove the element 56 is of the self-heating type which obtains its energy from the transformer secondary winding 40. In practice it is usually preferable that the electrical impedence of the source be equal to that of the sink in order to effect the most efficient power transfer, as is well known to those skilled in the art. Since the element 56 is nearly wholly resistive, the source sees nearly pure resistance, hence the electrical design is simplified where very little reactance need be taken into account. Preferably the cold resistance of the element 56 is substantially equal to the resistance of the source, comprising the transformer secondary winding 40, the leads 42 and 44, and the short lengths of the screws 70 and 72 (which can be considered as negligible under the circumstances). When the cold resistances are approximately equal the maximum power transfer occurs from the source to the sink and the element 56 is subjected to the near maximum flow of current which causes it to heat quite rapidly to operating temperature. As it heats up its resistance increases somewhat which causes a reduction in the current flow. When it reaches operating temperature, both temperature and current flow are stabilized. Preferably, the element 56 is formed of heat treatable stainless steel of 410 designation in order to permit relatively high temperatures of the order of 1,100°F over long periods of time without oxidation and corrosion of the element 56.

Those skilled in the art will recognize at once that the element 56 cools almost at once when the current flow ceases upon turn off of the switch 28, as contrasted by the long hot soak and slow cool down of the heating elements of the prior art. Furthermore, there is little accretion of heat in the housing portions 12 and 14 and cover 16, other than the nominal heat given off by the transformer 34 which is not convected off through the vent holes 46 or conducted off by the ribs 48 and 50. This is so because block 54 resists transfer of heat from the sink element 56 back to the housing.

Referring to FIG. 4, the operation of the tool 10 is illustrated in connection with the breaking of the seal by the sealant mastic 78 interposed between the windshield 80 and the windshield frame 82. In practice the tip end 62 of the element 56 is inserted into the mastic at a convenient place, after which the tool 10 is hand manipulated to force or run it around the periphery of the windshield until the waterproofing seal of the sealant 78 is softened and melted sufficiently to enable the windshield 80 to be forced gently by hand pressure out of the frame 82.

We claim:

1. A parting tool comprising:

an elongate blade-like element constructed of relatively thin flat sheet metal and having base and tip ends, said element having a longitudinal slot opening at one end through the base end of said element and terminating at its other end a distance from the tip end of said element, whereby said element has a generally U-shape including a pair of thin flat leg portions disposed in spaced side by side coplanar relation and a thin flat connecting portion joining said leg portions at the tip end of said element, said leg portions having opposite free ends, a realtively long and slender holder having at one end a high temperature heat resistive ceramic-like thermal insulating support member recessed into one side of said holder, means securing said free ends of said element leg portions to said insulating support member with said free ends recessed into said support member and with the blade-like element extending longitudinally from said one end of the holder, whereby said holder supports said element for application to work material, said element having a right angle bend between said holder end and said connecting portion whereby said element base and tip ends lie at opposite sides of said bend and are disposed in mutually transverse relationship, the tip end of said element extending laterally of and toward the opposite side of said holder in spaced relation to said holder end, and electrical circuit means carried by said holder and connected to said free ends of said element leg for providing an electrical current flow to said element leg and connecting portions to heat said element.

2. A parting tool according to claim 1 wherein:

said holder includes a housing at the opposite holder end, and said circuit means comprises a stepdown transformer within said housing and leads extending endwise through said holder from said housing to said one holder end and electrically connecting the transformer secondary winding to said free ends of said element leg portions.

3. A parting tool according to claim 2 wherein:

said means for securing said free ends of said element leg portions to said insulating support member comprise screws extending through the free ends and the support member and electrically contacting said leads.

* * * * *